US008338768B2

(12) United States Patent
Hanlon et al.

(10) Patent No.: US 8,338,768 B2
(45) Date of Patent: Dec. 25, 2012

(54) ACTUATION ASSEMBLY

(75) Inventors: Casey Hanlon, Queen Creek, AZ (US); Kellan Geck, Chandler, AZ (US); Andrew T. Johnson, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 1106 days.

(21) Appl. No.: 12/252,175

(22) Filed: Oct. 15, 2008

(65) Prior Publication Data

US 2012/0181372 A1 Jul. 19, 2012

(51) Int. Cl.
*F42B 10/66* (2006.01)
*F42B 10/00* (2006.01)
*F16H 27/02* (2006.01)

(52) U.S. Cl. ..... 244/3.22; 244/3.21; 244/52; 244/74; 74/89

(58) Field of Classification Search ..... 244/3.1, 244/3.15, 3.21, 3.22, 52, 74; 74/88, 89, 76, 74/80, 110, 519, 73 R
See application file for complete search history.

(56) References Cited

U.S. PATENT DOCUMENTS 3,999,381 A 12/1976 Liedel
4,038,673 A * 7/1977 Schroder ..... 396/378
4,482,107 A 11/1984 Metz
4,751,970 A * 6/1988 Hecker et al. ..... 173/104
4,956,992 A 9/1990 Undin
5,074,492 A 12/1991 Morgand
5,158,246 A * 10/1992 Anderson, Jr. ..... 244/3.22
5,456,425 A 10/1995 Morris et al.
5,533,331 A 7/1996 Campbell et al.
5,709,125 A 1/1998 Nakazawa et al.
5,755,401 A 5/1998 Frey et al.
5,845,528 A 12/1998 Wollermann
6,289,669 B1 9/2001 Smirra
6,510,786 B1 1/2003 Harsch
6,802,488 B1 * 10/2004 Patterson ..... 251/129.11
6,895,991 B2 5/2005 Woessner
7,102,113 B2 9/2006 Fujita et al.
7,287,725 B2 10/2007 Chasman et al.
2006/0021526 A1 * 2/2006 Martin et al. ..... 100/269.06

* cited by examiner

*Primary Examiner* — Timothy D Collins
*Assistant Examiner* — Marc Burgess
(74) *Attorney, Agent, or Firm* — Ingrassia Fisher & Lorenz P.C.

(57) ABSTRACT

An actuation assembly is provided. The actuation assembly includes a casing, a plurality of linear actuators coupled to the casing, each of the linear actuators having first and second components and being configured to move the second component thereof relative to the first component thereof along a respective first axis, and a plurality of translational member sets, each being coupled to the second component of a respective one of the linear actuators and the casing and being configured such that when the second component of the respective linear actuator moves along the respective first axis, a selected portion of the translational member set moves substantially along a respective second axis.

11 Claims, 9 Drawing Sheets

ACTUATION ASSEMBLY

TECHNICAL FIELD

The present invention generally relates to actuation assemblies and more particularly relates to an actuation system for use in the control system of a vehicle, such as an exoatmospheric kill vehicle.

BACKGROUND

Missile defense systems have been under development by the world's leading military powers since the latter part of the $20^{th}$ century. One category of such defense systems is designed to target and intercept strategic missiles, such as intercontinental ballistic missiles (ICBMs), often in exoatmospheric environments (i.e., very high altitudes).

One method for disabling such an object involves ramming a payload into it without making use of any explosive devices (i.e., using only the force of impact). These payloads are sometimes referred to as "exoatmospheric kill vehicles (EKVs)" or "kinetic kill vehicles (KKVs)" and are typically deployed by ground-based missile systems. Once deployed, EKVs may utilize on-board sensors and electrical systems, in combination with multiple sets of thrusters, to both stabilize the kill vehicle and to alter the trajectory thereof. Due to the high speeds at which the EKV and the target are traveling (e.g., several miles per second), maintaining precise control of the vehicle is essential.

Accordingly, it is desirable to provide an improved actuation assembly that may be used, for example, in the control system of an EKV (or other maneuverable kill vehicle). Furthermore, other desirable features and characteristics of the present invention will become apparent from the subsequent detailed description of the invention and the appended claims, taken in conjunction with the accompanying drawings and this background of the invention.

BRIEF SUMMARY

An actuation assembly is provided. The actuation assembly includes a casing, a plurality of linear actuators coupled to the casing, each of the linear actuators having first and second components and being configured to move the second component thereof relative to the first component thereof along a respective first axis, and a plurality of translational member sets, each being coupled to the second component of a respective one of the linear actuators and the casing and being configured such that when the second component of the respective linear actuator moves along the respective first axis, a selected portion of the translational member set moves substantially along a respective second axis.

A control system for a maneuverable kill vehicle is provided. The control system includes a pressurized fluid source configured to provide a pressurized fluid, a plurality of valves in fluid communication with the pressurized fluid source, and an actuation assembly. The actuation assembly includes a casing, a plurality of linear actuators coupled to the casing and symmetrically arranged about a central axis, each of the linear actuators having first and second components and being configured to move the second component thereof relative to the first component thereof along a respective first axis, and a plurality of translational member sets, each being coupled to the second component of a respective one of the linear actuators and the casing and being configured such that when the second component of the respective linear actuator moves along the respective first axis, a selected portion of the translational member set moves substantially along a respective second axis. Each second axis is substantially orthogonal to the respective first axis. The selected portion of each of the plurality of translational member sets is coupled to a respective one of the plurality of valves such that the movement of the selected portion of the valve causes an adjustment in a flow rate of the pressurized fluid through the valve.

A maneuverable kill vehicle is provided. The maneuverable kill vehicle includes a frame, a pressurized fluid source connected to the frame configured to provide a pressurized fluid, a plurality of valves in fluid communication with the pressurized fluid source, an actuation assembly, and a controller in operable communication with the actuation assembly. The actuation assembly includes a plurality of linear actuators coupled to the frame, each of the linear actuators having first and second components and being configured to move the second component thereof relative to the first component thereof along a respective first axis and a plurality of translational member sets, each being coupled to the second component of a respective one of the linear actuators and the frame and being configured such that when the second component of the respective linear actuator moves along the respective first axis, a selected portion of the translational member set moves substantially along a respective second axis. An angle between the respective first axis and the respective second axis being at least 45 degrees. The selected portion of each of the plurality of translational member sets is coupled to a respective one of the plurality of valves such that the movement of the selected portion of the valve causes an adjustment in a flow rate of the pressurized fluid through the valve. The controller is configured to selectively cause the second components of the linear actuators to move relative to the first components of the linear actuators.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, and brief summary or the following detailed description. It should also be noted that FIGS. 1-10 are merely illustrative and may not be drawn to scale.

FIG. 1 to FIG. 10 illustrate an actuation assembly that may be used in a vehicular control system. Although the example described below is a control system for a maneuverable kill vehicle, it should be understood that the control system may be used in vehicles other than exoatmospheric vehicles, such as aircraft, watercraft, and ground vehicles. In one embodiment a control system includes a pressurized fluid source configured to provide a pressurized fluid, a plurality of valves in fluid communication with the pressurized fluid source, and the actuation assembly. The actuation assembly includes a plurality of linear actuators coupled to a casing. Each of the linear actuators is configured for movement along a respective first axis. A translational member sets is coupled to each linear actuator and configured such that the movement along the first axis causes a selected portion thereof to move along a respective second axis. An angle between the respective first axis and the respective second axis may be at least 45 degrees. In one embodiment, the axes are orthogonal. The selected portion of each of the translational member sets is coupled to a respective one of the plurality of valves such that the movement of the selected portion of the valve causes an adjustment in a flow rate of the pressurized fluid through the valve.

Figure 1:
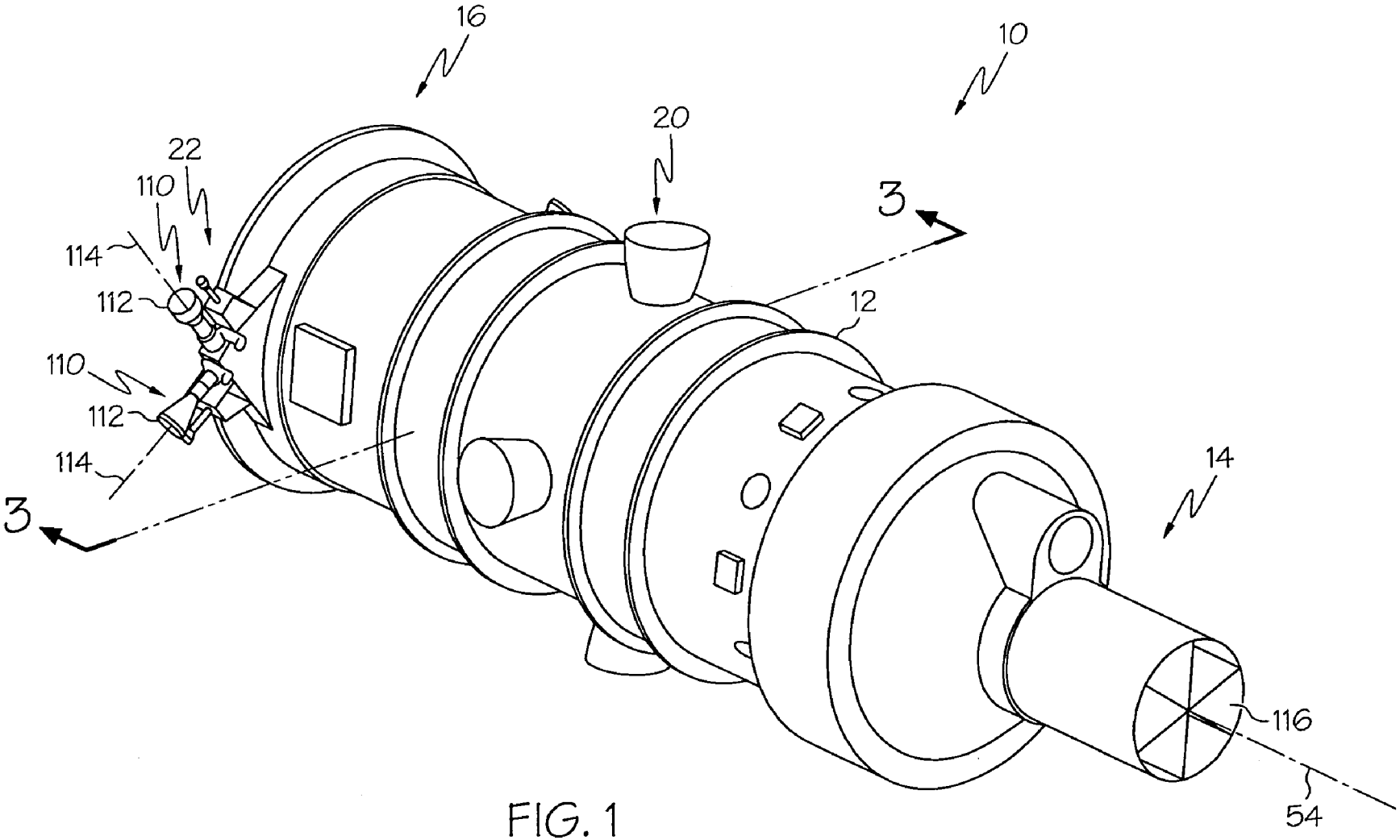
FIG. 1 is an isometric view of an exoatmospheric kill vehicle (EKV), according to one embodiment of the present invention.
Figure 2:
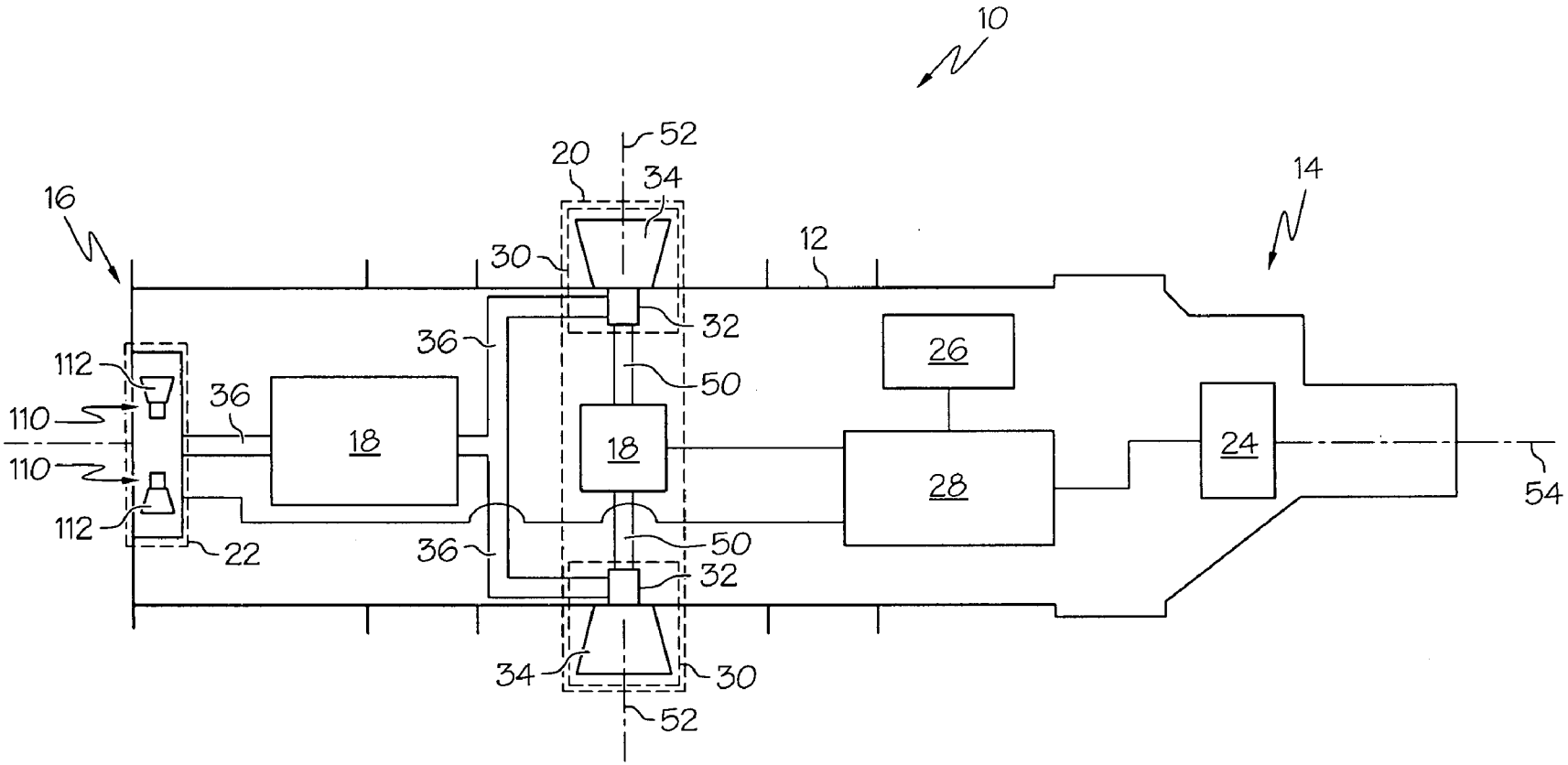
FIG. 2 is a cross-sectional schematic block diagram of the vehicle of FIG. 1.

FIGS. 1 and 2 illustrate a maneuverable kill vehicle (e.g., an exoatmospheric kill vehicle (EKV) or a kinetic kill vehicle (KKV)) 10, according to one embodiment of the present invention. The vehicle 10 includes a body (or frame) 12 with a forward end 14 and an aft end 16. Housed within the body 12 are a pressurized fluid system 18, a divert thruster system 20, an attitude and control thruster system (ACS) 22, a sensor array 24, a navigation system 26, and an electronic control system 28.

The pressurized fluid system (or supply or source) 18 is located near a central portion of the body 12 and is configured to provide a pressurized fluid to the divert and ACS thruster systems 20 and 22. In one embodiment, the pressurized fluid system 18 includes a solid propellant gas generator (e.g., a solid rocket fuel or propellant engine). In another embodiment, the fluid system includes a container of an inert, pressurized gas, such as nitrogen. Although shown in FIG. 1, and perhaps referred to as a single system (or source), the pressurized fluid system 18 may include two, separate pressurized fluid sources for the divert thruster system 20 and the ACS thruster system 22.

Figure 3:
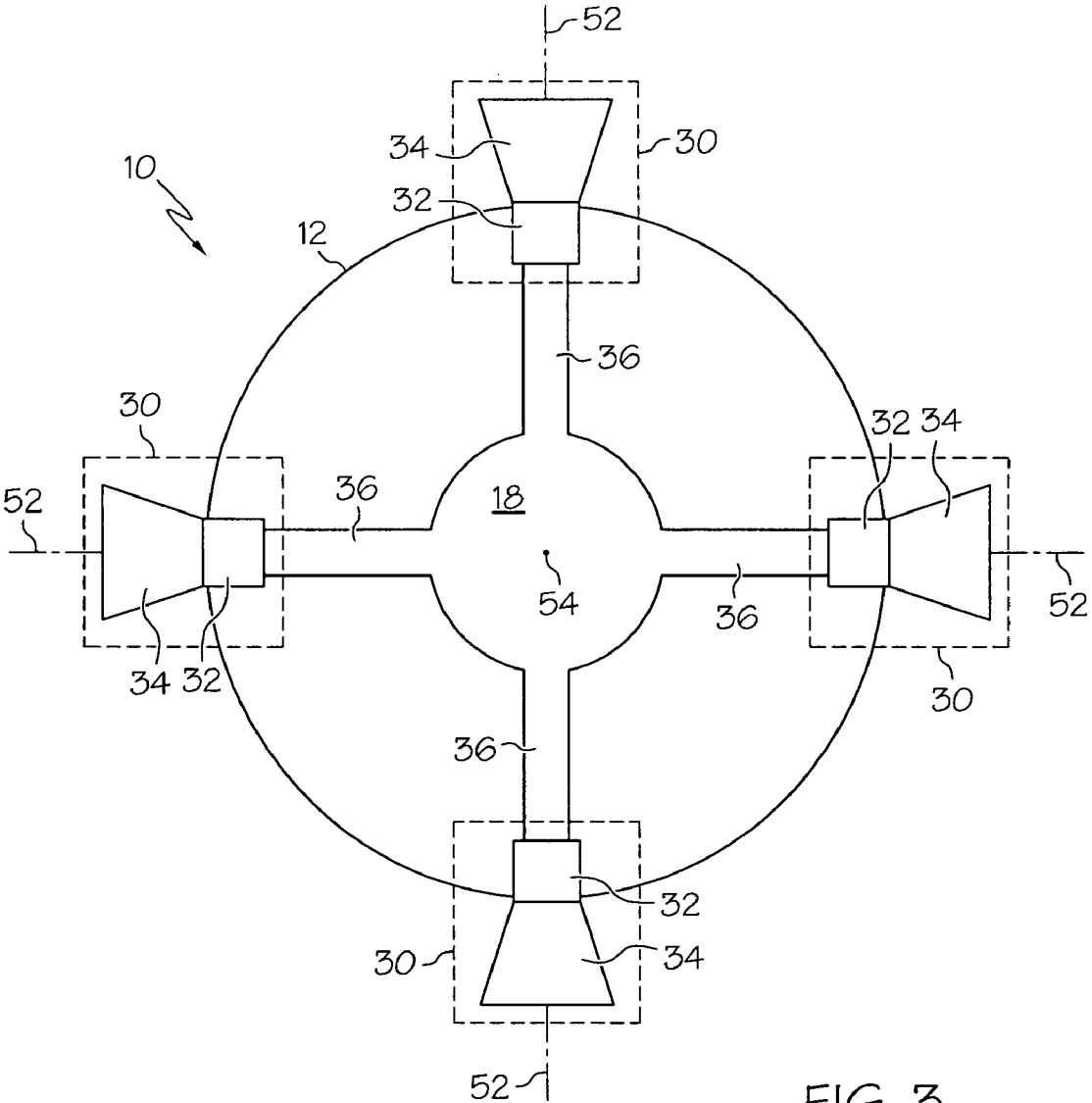
FIG. 3 is a cross-sectional schematic view of the vehicle of FIG. 1 taken along line 3-3.

Referring to FIGS. 1, 2, and 3, the divert thruster system 20 is located near the central portion of the body 12 and includes four divert thruster assemblies 30, located at respective top, bottom, and lateral sides of the body 12, and a divert thruster actuator assembly 31. Each of the divert thruster assemblies 30 includes a divert thruster valve 32 and a divert thruster nozzle 34.

Figure 5:
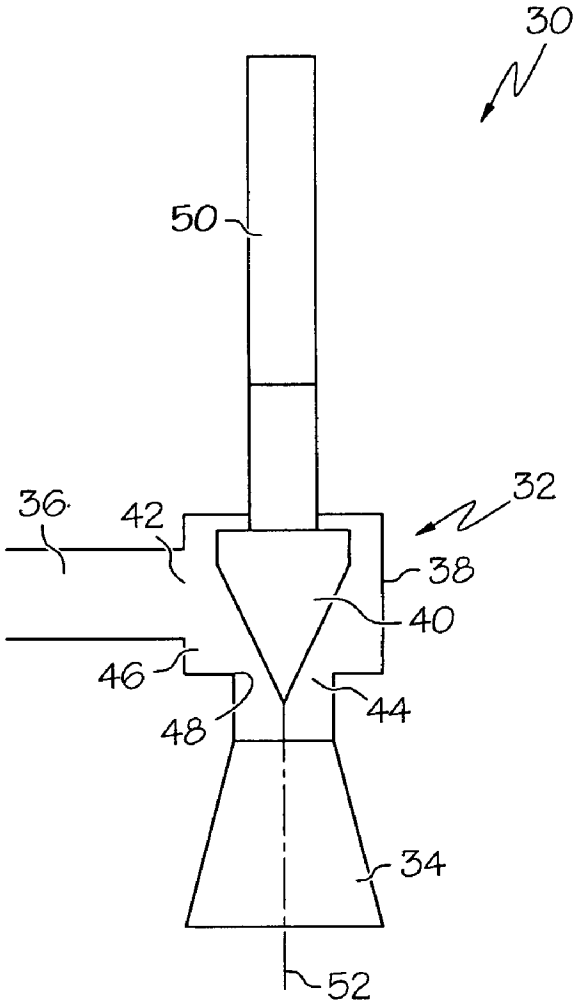
FIGS. 4 and 5 are schematic views of a thruster assembly within the vehicle of FIG. 1.
Figure 4:
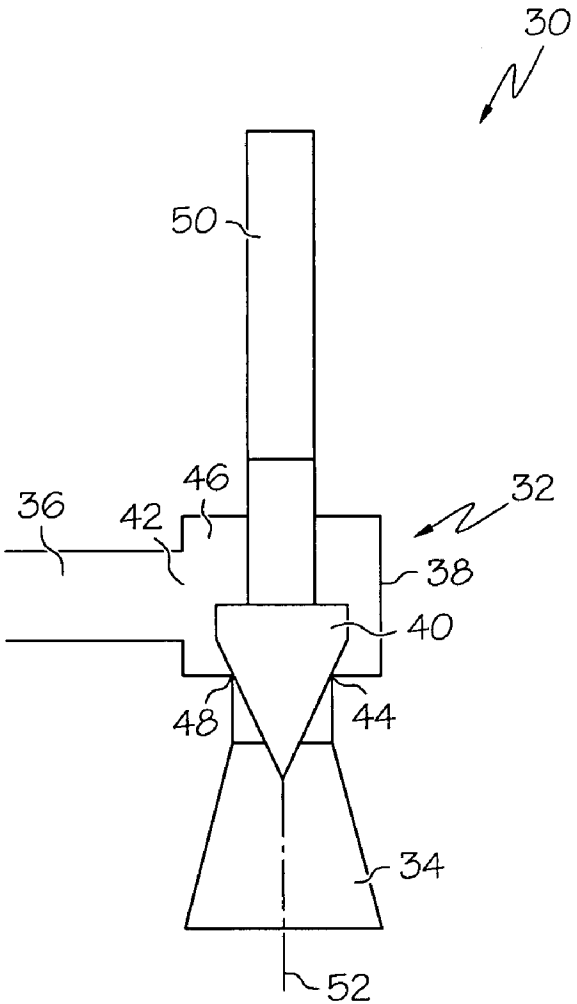

Referring now to FIGS. 2, 3 and 4, the divert thruster valves 32 each include a valve body 38 and a valve member 40. The valve body 38 includes an inlet port 42, an outlet port 44, and a passageway 46 therethrough that interconnects the ports 42 and 44. The valve body 38 (of each assembly 30) is in fluid communication with the fluid source 18 through the fluid conduits 36. Referring specifically to FIGS. 4 and 5, the valve member 40 is moveable within the passageway 46 between first and second positions. As shown in FIG. 4, in the first position, the valve member 40 blocks the flow of fluid through the valve body 38 by mating with an inner edge 48 of the outlet port 44. In the second position, as shown in FIG. 5, the valve member 40 is pulled away from the outlet port 44 so that fluid may pass through the valve body 38. The valve member 40 and/or the valve body 38 may be sized such that the valve member 40 has a clearance within the passageway 46 of, for example, between 0.25 and 0.50 inches. The valve member 40 is connected to the divert actuator assembly 31 through a shaft 50, or a first translational member, as described below.

Although perhaps not drawn to scale, it should be understood that in at least one embodiment, the divert thruster valves 32 are "pintle valves," as is commonly understood. As such, in the depicted embodiment, the valve member 40 is in the shape of a "pintle" (e.g., a pin or needle) and has a tapered shaped such that when in the first position, at least a tip of the valve member 40 extends through the outlet port 44 as shown in FIG. 4. Referring again to FIGS. 2 and 3, the divert thruster nozzles 34 are arranged such that central axes 52 thereof are substantially perpendicular to and intersect a primary axis 54 of the body 12 (e.g., a roll axis of the vehicle 10).

Figure 6:
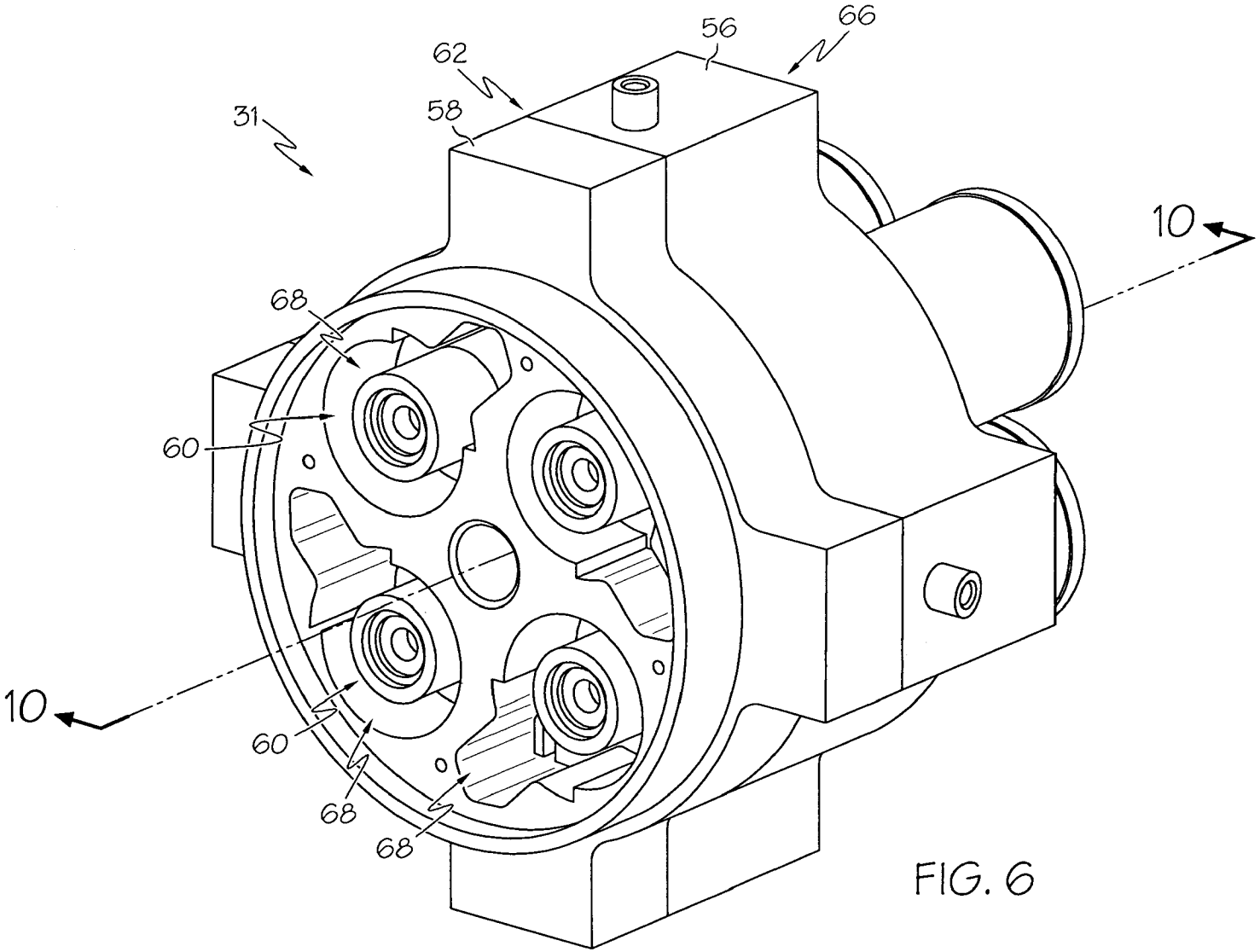
FIG. 6 is an isometric view of an actuation assembly coupled to the thruster assembly of FIGS. 4 and 5, according to one embodiment of the present invention.
Figure 7:
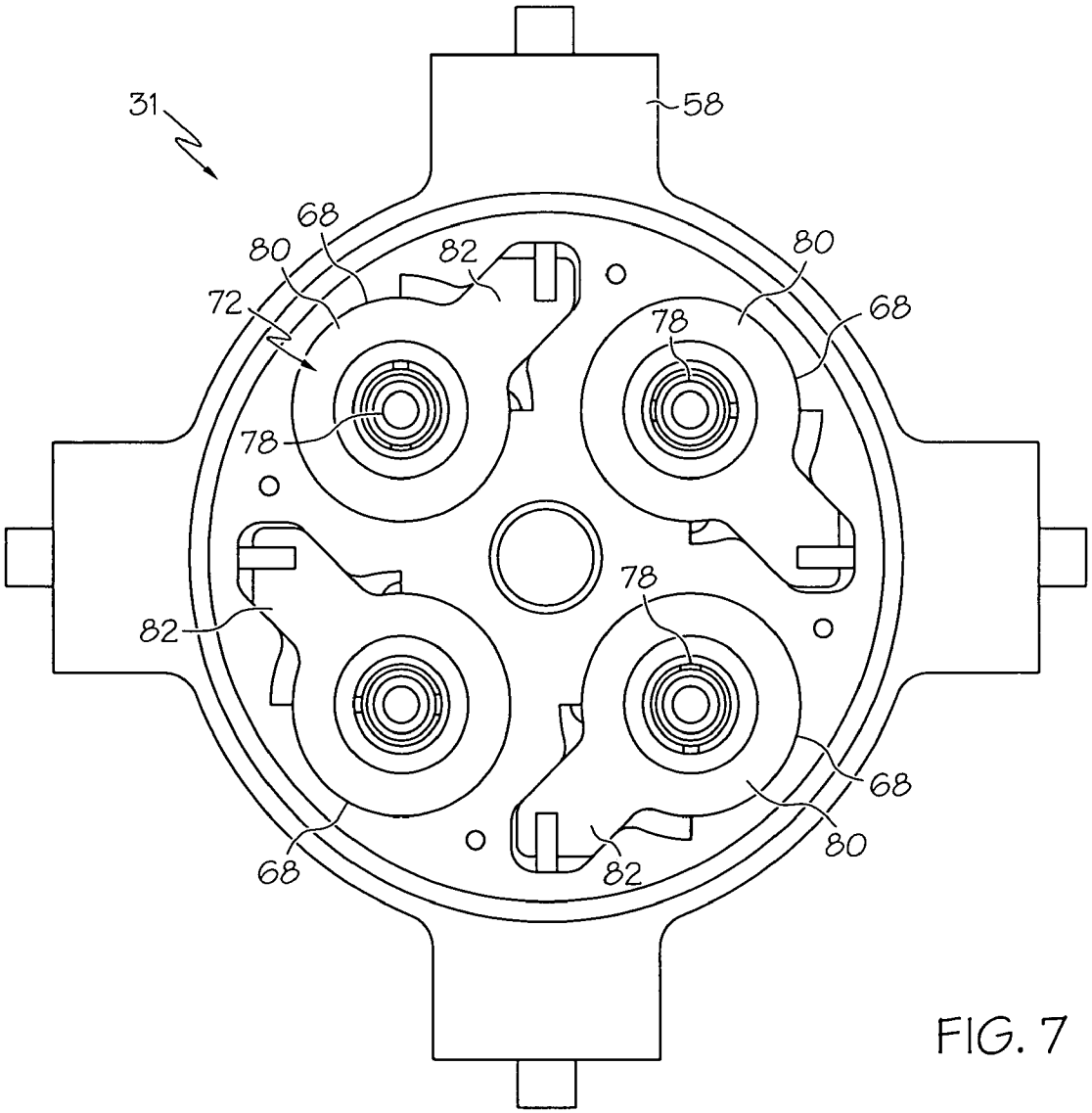
FIG. 7 is a plan view of a first side of the actuation assembly of FIG. 6.

FIGS. 6-10 illustrate the divert thruster actuator assembly (or actuation assembly) 31, according to one embodiment of the present invention. The actuator assembly 31 includes a casing 56, a slot plate 58, and four actuator mechanisms 60. The casing 56 is substantially disc-shaped, and in the depicted embodiment, has a first side 62 with four linkage cavities 64 symmetrically arranged around a periphery thereof and a second, opposing side 66 having four motor cavities (not shown) formed thereon. Referring specifically to FIGS. 6 and 7, the slot plate 58 is connected to the first side 62 of the casing 56 and includes four ball screw slots 68 that extend therethrough.

Figure 8:
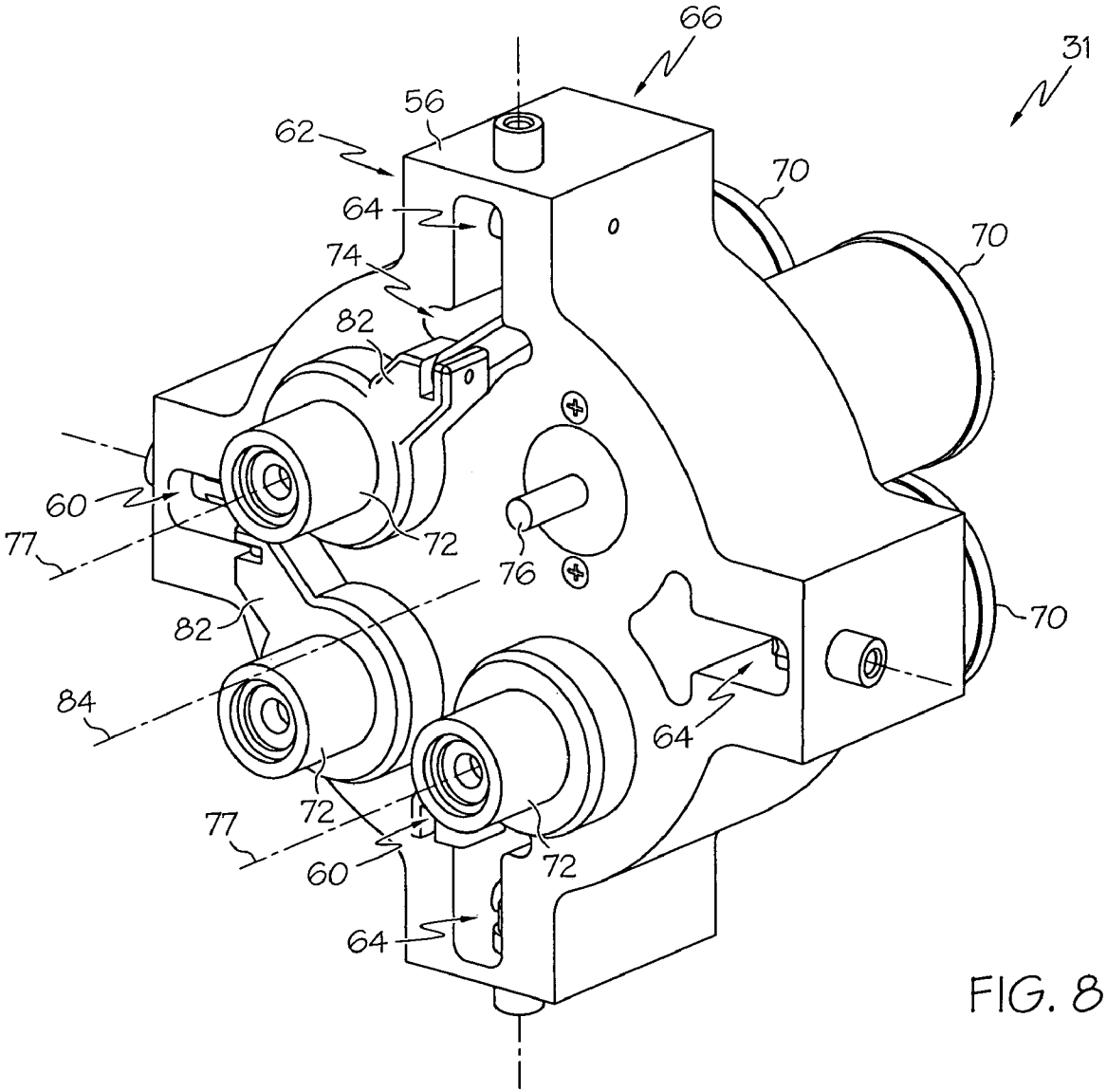
FIG. 8 is an isometric view of the actuation assembly of FIG. 8 with several components thereof removed.

Referring now to FIGS. 7, 8, 9, and 10, each of the actuator mechanisms 60 includes a rotary motor 70, a ball screw 72, and a translational linkage set 74. The rotary motors 70 are each inserted into one of the motor cavities on the second side 66 of the casing 56 and include a motor shaft 76 that extends through shaft openings through the casing 56, as shown in FIG. 8, which illustrates the actuator assembly 31 with the slot plate 58 and one of the ball screws 72 removed. As is commonly understood, the rotary motors 70 may each include a stator assembly, including multiple conductive coils, and a rotor assembly, having a ferromagnetic core, which rotates about a motor axis 77 (FIG. 8) when current is conducted through the conductive coils.

The balls screws 72 each include an inner component 78 and an outer component 80. The inner component 78 is connected to the motor shaft 76 of a respective rotary motor 70. The outer component 80 is rotatably connected to the inner component 78 via a series of threaded formations (not shown) and includes a tab 82 extending from one side thereof. As shown in FIG. 8, the actuation mechanisms 60 are symmetrically arranged about a central axis 84, which is substantially parallel to the motor axes 77. The threaded formations that interconnect the inner and outer components 78 and 80 are arranged such that if the outer component 80 is prevented from rotating, rotation of the inner component 78 (with the shaft 76) causes the outer component 80 to move along the respective motor axis 77. As such, each pair of one rotary motor 70 and ball screw 72 may be understood to jointly form a linear actuator. It should be understood that other embodiments may utilize other types of linear actuators, such as hydraulic actuators and electric linear actuators. As shown in FIGS. 6 and 7, the ball screw slots 68 in the slot plate 58 are shaped and mated with the outer components 80 to perform such an "anti-rotation" function.

Still referring to FIGS. 7-10, in the depicted embodiment, each of the translational linkage (or member) sets 74 is positioned within a respective one of the linkage cavities 64 and includes a first member 86, a second member 88, and a third member 90. The first member 86, which may be integrally connected with a respective one of the shafts 50 (FIGS. 2, 4, and 5), extends through a respective side of a periphery of the casing 56 substantially along a translational axis 92. As shown, the actuator mechanisms 60 are arranged symmetrically arranged about the central axis 84 such that the translational axes 92 are mutually perpendicular and planar.

The first member 86 includes a first engagement formation 94 at an inner end thereof. In the depicted embodiment, the first engagement formation 94 is a slot with a length 96 and a width 98. The length 96 may be measured in a direction substantially perpendicular to the translational axis (or substantially parallel to axes 77 and 84), and the width 98 may be measured in a direction substantially parallel to the translational axis 92 (or substantially perpendicular to axes 77 and 84). As shown, the length 96 of the slot 94 is greater than the width 98 of the slot 94.

The second member 88 has a substantially "L" shape and is rotatably coupled to the casing 56 via a fixed pin 100 such that the second member 88 may rotate relative to the casing 56 about a pin axis 102. The second member 88 includes a first moveable pin (or second engagement formation) 104 at a first end thereof and a second moveable pin 106 at a second end thereof. It should be noted that the terms "fixed" and "moveable" may refer simply to the movability of the respective pins relative to the casing 56. The first moveable pin 104 is positioned a distance 108 from the fixed pin 100 and is inserted through the slot 94 on the first member 86. As is evident in FIG. 10, the first moveable pin 104 has a substantially circular cross-section and is sized such that it may move between the opposing ends of the slot 94 in a direction substantially perpendicular to the translational axis 92. That is, the first moveable pin 104 has a "length" that is less than the length 96 of the slot 94 and a "width" that is substantially the same as the width 98 of the slot 94.

The third member 90 has an elongate shape and interconnects the second member 88 and the tab 82 of the outer member 80 of the respective ball screw 72. Specifically, the third member 90 is rotatably coupled to the second member 88 via the second moveable pin 106 and rotatably coupled to the respective tab 82 via a ball screw pin 109.

Referring again to FIGS. 1 and 2, the ACS thruster system 22 is located near the aft end 16 of the body 12 and includes four ACS thruster assemblies 110. Each of the ACS thruster assemblies 110 includes an ACS thruster nozzle 112 and an associated ACS thruster valve and actuator (not shown). Each of the ACS thruster nozzles 112 is symmetric about a respective ACS axis 114, which is orthogonal to, and does not intersect, the primary axis 54 of the vehicle 10. The ACS thruster valves are in fluid communication with the fluid source 18 through the array of fluid conduits 36 and are operable between "open" and "closed" modes to control the flow of the pressurized fluid through the ACS nozzle thruster nozzles 112 to the exterior of the vehicle 10, as will be described in greater detail below.

Referring again to FIG. 2, the sensor array 24 is located near the forward end 14 of the body 12, and although not specifically shown, includes multiple electromagnetic sensors, such as optical and infrared sensors, that are directed (i.e., aimed) through an opening 116 at the forward end 14 of the body 12.

Although not specifically shown, the navigation system 26 includes multiple gyroscopes and accelerometers configured to detect changes in angular orientation and acceleration, respectively, in three dimensions. The navigation system 26 also includes one of more receivers for receiving data (e.g., commands and positional data) from various sources, such as ground-based and satellite-based transmitters.

The electronic control system (or controller) 28 may be in the form of a computer, or computing system, having a memory (i.e., computer-readable medium) for storing a set of instructions (i.e., software) and a processing system, including various circuitry and/or integrated circuits, such as field programmable gate arrays (FPGAs), application specific integrated circuits (ASICs), discrete logic, microprocessors, microcontrollers, and digital signal processors (DSPs), connected to the memory for executing the instructions, as is commonly understood in the art. The instructions stored within the control system 28 may include the methods and processes for controlling the vehicle 10 as described below. Although not shown, the electronic control system 28 includes a power supply, which may be any one of various types of variable direct current (DC) power supplies. The electronic control system 28 (and/or the power supply) is electrically connected to, or in operable communication with, the rotary motors 70, the ACS thruster actuators, the sensor array 24, and the navigation system 26.

Although not shown, the vehicle 10 may also include a propulsion thruster and associated valve at the aft end thereof, which is in fluid communication with the pressurized fluid supply 18.

In operation, the vehicle 10 may be deployed into an exoatmospheric environment by a suitable delivery system (e.g., a rocket). Once deployed, the vehicle 10 receives data and commands through the navigation system 26, which the electronic control system 28 uses to selectively activate the divert and ACS thruster systems 20 and 22. In response to slight, undesired variations in the trajectory of the vehicle 10 (e.g., as detected by the gyroscopes and accelerometers in the navigation system 26), the electronic control system 28 may selectively activate the ACS thruster assemblies 110 to stabilize the vehicle 10 (e.g., stop the vehicle 10 from tumbling and/or spinning, as well as orientate it such that it is pointed towards the desired target).

The trajectory of the vehicle 10 may be adjusted using the divert thruster assemblies 30, which as configured with the pressurized fluid source cause relatively large forces to be exerted on the body 12 of the vehicle 10.

Figure 9:
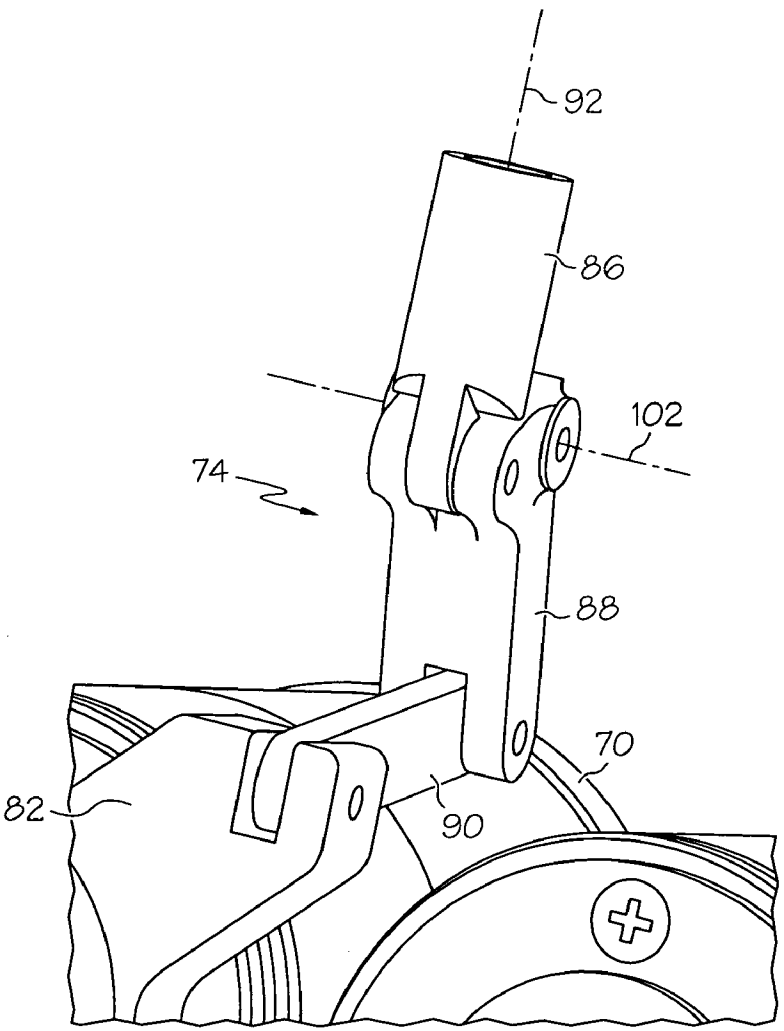
FIG. 9 is an isometric view of a linkage assembly within the actuation assembly of FIGS. 6, 7, and 8.
Figure 10:
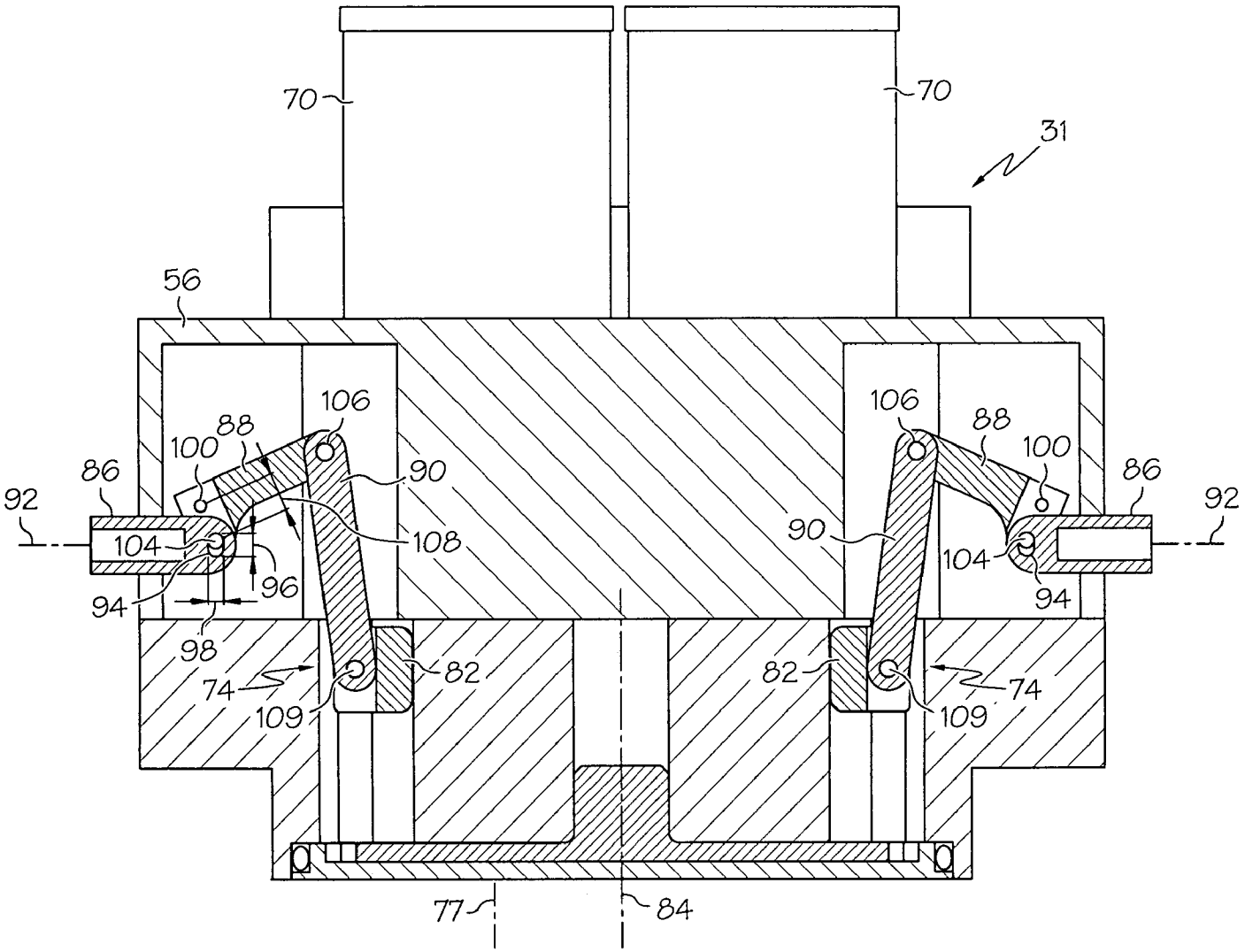
FIG. 10 is a cross-sectional side view of the actuation assembly of FIG. 6 taken along line 10-10.

Referring to FIGS. 1, 2, 6, 7, and 8, the electronic control system 28 (or the power supply therein) selectively activates one or more of the rotary motors 70, which causes the motor shaft 76 thereof to rotate (i.e., about the respective motor axis 77). The combination of the rotation of the motor shafts 76 and the anti-rotation of the outer portions 80 of the respective ball screws 72 caused by the ball screw slots 68 in the slot plate 58 causes the outer portions 80 of the ball screws 72 to move along the respective motor axes 77. Referring to FIGS. 9 and 10, the movement of the outer portion 80 (and the tab 82) of the ball screw 72 causes a similar motion in the third member 90 of the translational linkage set 74, which likewise causes the second member 88 to pivot about the pin axis 102. The distance 108 between the fixed pin 100 and the first moveable pin 104 of the second member 88, causes the first moveable pin 104 to move along an arc as the second member 88 is pivoted about the pin axis 102. As such, the pivoting motion of the second member 88 causes the first member 86 to move along the translational axis 92 (i.e., in a direction substantially orthogonal to axes 77 and 84).

Of particular interest in FIG. 10 is that because of the dimensions of the slot 94 and the first moveable pin 104, as the first moveable pin 104 moves along the arc the first moveable pin 104 may slide within the slot 94 in a direction substantially parallel to the respective motor axis 77 (and the central axis 84). As a result, only negligible forces are exerted on the first member 86 in directions parallel to the motor axis 77 while the first member 86 is being moved back and forth along the translational axis 92.

Referring now to FIGS. 4, 5, and 10, the movement of the first member 86 of each translational linkage set 74, which is connected to one of the shafts 50, causes the valve member 40 of the respective divert thruster valve 32 to move between the first and second positions. That is, the movement of the first members 86 opens and closes the divert thruster valves 32. In the particular arrangement shown, as the outer portions 80 of the ball screws 72 are retracted towards the respective rotary motor 70, the respective first member 86 is pulled inward toward the central axis 84, which moves the valve member 40 of the respective divert thruster valve 32 into the second position (FIG. 5), and thus opens the valve 32. As a result, pressurized fluid is allowed to pass through the valve body 38 and be evacuated through the divert thruster nozzle 34, causing a force to be exerted on the vehicle 10 sufficient to change the trajectory thereof. Likewise, when the outer portions 80 of the ball screws 72 are extended away from the respective rotary motor 70, the first members 86 are pushed away from the central axis 84, which moves the valve member 40 into the first position and thus closes the respective valve 32.

One advantage of the control system described above is that because of the arrangement of the rotary motors (i.e., symmetrically arranged about and parallel to a central axis), the amount of radial space occupied by the actuation assembly is minimized. Another advantage is that because of the manner in which the first and second members of the translational linkage sets are interconnected, the divert valves can be controlled with a substantially linear motion without straining the first member. Additionally, because the dimensions of the engagement formations in the direction parallel to the linear motion are substantially the same, the linear motion, and thus the valves. may be precisely controlled.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. An actuation assembly comprising:

a casing;

a plurality of linear actuators coupled to the casing and symmetrically arranged about a central axis, each of the linear actuators having first and second components and being configured to move the second component thereof relative to the first component thereof along a respective first axis; and a plurality of translational member sets, each being coupled to the second component of a respective one of the linear actuators and the casing and being configured such that when the second component of the respective linear actuator moves along the respective first axis, a selected portion of the translational member set moves substantially along a respective second axis, each of the second axes substantially orthogonal to the respective first axis, wherein:

the translational member sets each comprise at least first and second members, the first member comprising the selected portion of the respective translational member set and a first engagement formation and the second member being coupled to the casing to rotate about a third axis and comprising a second engagement formation a distance from the third axis and mated with the first engagement formation, and the first and second engagement formations each have a length as measured in a direction substantially parallel to the first axis, the length of the first engagement formation being substantially different from the length of the second engagement formation.

2. The actuation assembly of claim 1, wherein the first and second engagement formations each have a width as measured in a direction substantially parallel to the second axis, the width of the first engagement formation being substantially the same as the width of the second engagement formation.

3. The actuation assembly of claim 2, wherein the second engagement formation has a length that is substantially less than the length of the first engagement formation and the first and second members are arranged such that the second engagement formation translates between first and second ends of the first engagement formation when the second component of the respective linear actuator moves along the respective first axis.

4. The actuation assembly of claim 3, wherein each translational member set further comprises a third member being rotatably coupled to the second member and the second component of the respective linear actuator.

5. The actuation assembly of claim 1, wherein each of the linear actuators comprises a rotary motor and a ball screw.

6. The actuation assembly of claim 5, wherein the casing is shaped to prevent rotation of the ball screw of each of the linear actuators during operation of the respective rotary motor.

7. A control system for a maneuverable kill vehicle comprising:

a pressurized fluid source configured to provide a pressurized fluid;

a plurality of valves in fluid communication with the pressurized fluid source; and an actuation assembly comprising:

a casing;

a plurality of linear actuators coupled to the casing and symmetrically arranged about a central axis, each of the linear actuators having first and second components and being configured to move the second component thereof relative to the first component thereof along a respective first axis, and each of the linear actuators comprising a rotary motor and a ball screw and the casing is shaped to prevent rotation of the ball screw of each of the linear actuators during operation of the respective rotary motor; and a plurality of translational member sets, each being coupled to the second component of a respective one of the linear actuators and the casing and being configured such that when the second component of the respective linear actuator moves along the respective first axis, a selected portion of the translational member set moves substantially along a respective second axis, each second axis being substantially orthogonal to the respective first axis, wherein the selected portion of each of the plurality of translational member sets is coupled to a respective one of the plurality of valves such that the movement of the selected portion of the valve causes an adjustment in a flow rate of the pressurized fluid through the valve, wherein the translational member sets each comprise at least first and second members, the first member comprising the selected portion of the respective translational member set and a first engagement formation and the second member being coupled to the casing to rotate about a third axis and comprising a second engagement formation a distance from the third axis and mated with the first engagement formation, and wherein the first and second engagement formations each have a length as measured in a direction substantially parallel to the first axis, the length of the first engagement formation being substantially different from the length of the second engagement formation and the first and second engagement formations each have a width as measured in a direction substantially parallel to the second axis, the width of the first engagement formation being substantially the same as the width of the second engagement formation.

8. The control system of claim 7, wherein the second engagement formation has a length that is substantially less than the length of the first engagement formation and the first and second members are arranged such that the second engagement formation translates between first and second ends of the first engagement formation when the second component of the respective linear actuator moves along the respective first axis.

9. A maneuverable kill vehicle comprising:

a frame;

a pressurized fluid source connected to the frame configured to provide a pressurized fluid;

a plurality of valves in fluid communication with the pressurized fluid source;

an actuation assembly comprising:

a plurality of linear actuators coupled to the frame and symmetrically arranged about a central axis, each of the linear actuators having first and second components and being configured to move the second component thereof relative to the first component thereof along a respective first axis; and a plurality of translational member sets, each being coupled to the second component of a respective one of the linear actuators and the frame and being configured such that when the second component of the respective linear actuator moves along the respective first axis, a selected portion of the translational member set moves substantially along a respective second axis, each of the second axes substantially orthogonal to the respective first axis, an angle between the respective first axis and the respective second axis being at least 45 degrees, wherein the selected portion of each of the plurality of translational member sets is coupled to a respective one of the plurality of valves such that the movement of the selected portion of the valve causes an adjustment in a flow rate of the pressurized fluid through the valve; the translational member sets each comprise at least first and second members, the first member comprising the selected portion of the respective translational member set and a first engagement formation and the second member being coupled to the casing to rotate about a third axis and comprising a second engagement formation a distance from the third axis and mated with the first engagement formation, and wherein the first and second engagement formations each have a length as measured in a direction substantially parallel to the first axis, the length of the first engagement formation being substantially different from the length of the second engagement formation and the first and second engagement formations each have a width as measured in a direction substantially parallel to the second axis, the width of the first engagement formation being substantially the same as the width of the second engagement formation; and a controller in operable communication with the linear actuators and configured to selectively cause the second components of the linear actuators to move relative to the first components of the linear actuators.

10. The maneuverable kill vehicle of claim 9, wherein when the pressurized fluid flows through each of the plurality of valves, a force is exerted on the frame.

11. The maneuverable kill vehicle of claim 10, further comprises a second plurality of valves in fluid communication with the pressurized fluid source and wherein the second plurality of valves and the pressurized fluid source are configured such that when the pressurized fluid flows through each of the second plurality of valves, a second force is exerted on the frame, the second force being less than the first force.

* * * * *